United States Patent [19]

Vick

[11] 4,071,160

[45] Jan. 31, 1978

[54] INSULATED BEER KEG CONTAINER

[75] Inventor: Carl J. Vick, Portland, Oreg.

[73] Assignee: Keg-Tainer, Inc., Portland, Oreg.

[21] Appl. No.: 728,317

[22] Filed: Sept. 30, 1976

[51] Int. Cl.[2] ..... B65D 7/02; B65D 7/00; B65D 25/00

[52] U.S. Cl. ..... 220/5 R; 220/9 E; 220/17; 220/4 B; 62/400

[58] Field of Search ..... 220/9 E, 9 F, 3.1, 17, 220/23.83, 5 A, 5 R, 4 B, 94 A, 389; 206/521, 511; 62/398, 400

[56] References Cited

U.S. PATENT DOCUMENTS

| | | | |
|---|---|---|---|
| 1,042,084 | 10/1912 | Childs | 62/398 X |
| 1,863,793 | 6/1932 | Hermani | 220/94 A X |
| 2,060,941 | 11/1936 | Kline et al. | 220/9 E |
| 2,076,893 | 4/1937 | Johnson | 220/17 X |
| 2,792,692 | 5/1957 | Bryan | 4/400 X |
| 3,094,448 | 6/1963 | Cornelius | 220/9 F X |
| 3,103,278 | 9/1963 | Kuzma et al. | 206/511 X |
| 3,312,373 | 4/1967 | Gentry | 220/9 F X |
| 3,789,622 | 2/1974 | Yanes | 62/400 X |

*Primary Examiner*—William T. Dixson, Jr.
*Assistant Examiner*—Steven M. Pollard
*Attorney, Agent, or Firm*—Klarquist, Sparkman, Campbell, Leigh, Hall & Whinston

[57] ABSTRACT

A container adapted to receive a beer keg includes a cup-like top section fitting telescopically into the upper portion of a cup-like bottom section having a ring-like rim rolled at opposite points to provide handles. The rim has pairs of slots therethrough for binding straps and also has holes for binding ropes. Each section has an outer skin of a tough plastic with inner and outer walls with the spaces between the walls filled with a plastic foam. The sections are adapted to nest in each other for shipping and handling, and the bottom section has lugs designed to engage the rim of the top section. The top section has an elliptical bung hole to provide access to bungs of different makes of kegs, and a tubular stack may be fitted therein to retain ice for cooling and sealing. The bottom section has a bung access hole in its side which can be sealed by a truncated hollow ball having an opening to receive a tap connected to a lower bung of a keg.

13 Claims, 7 Drawing Figures

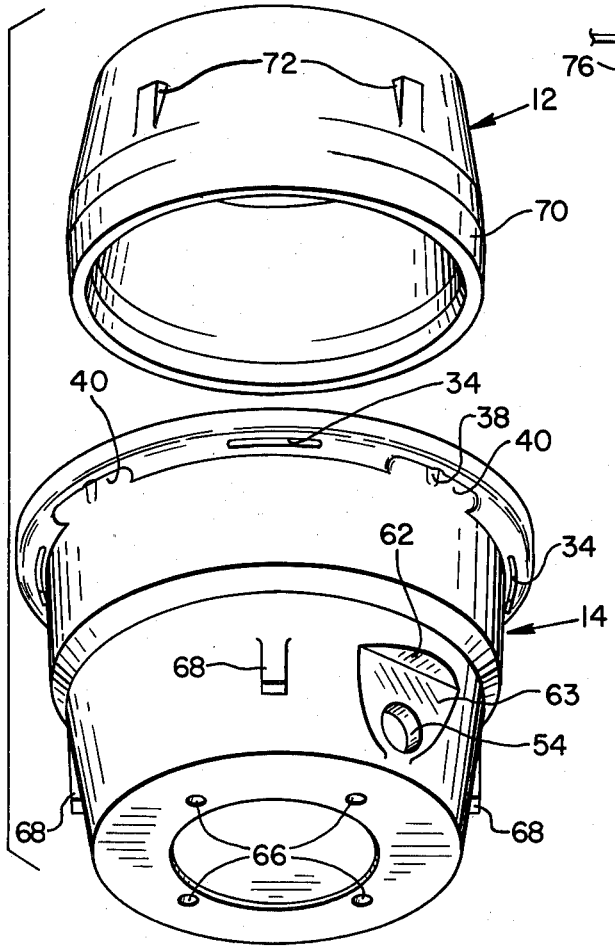
FIG. 4
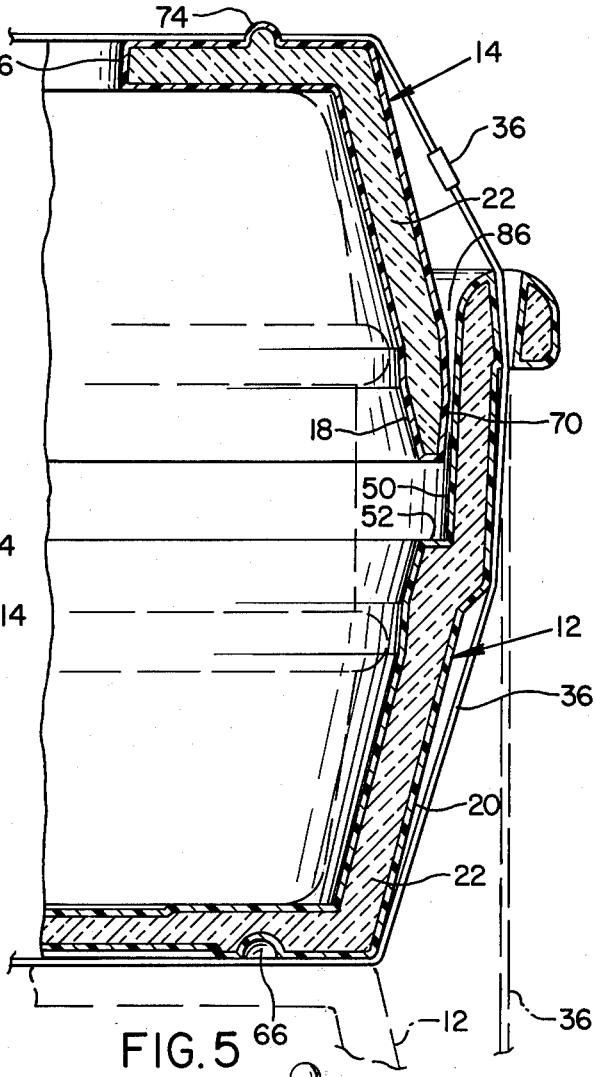
FIG. 5
FIG. 6
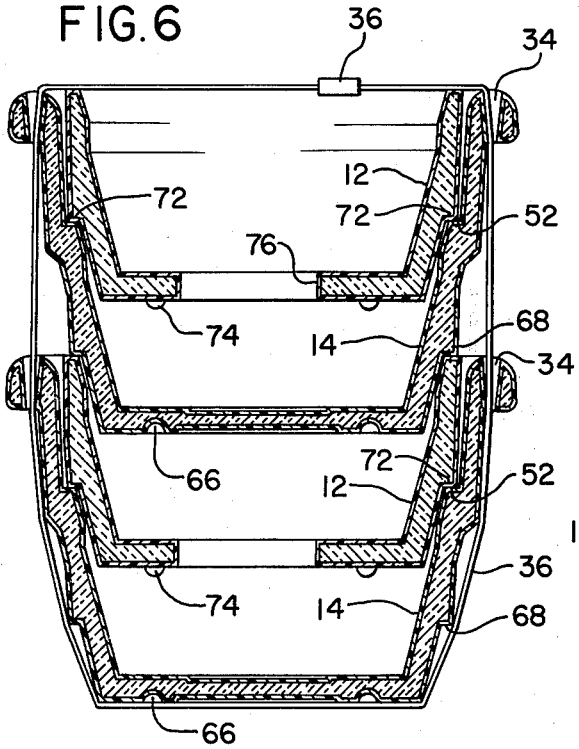
FIG. 7
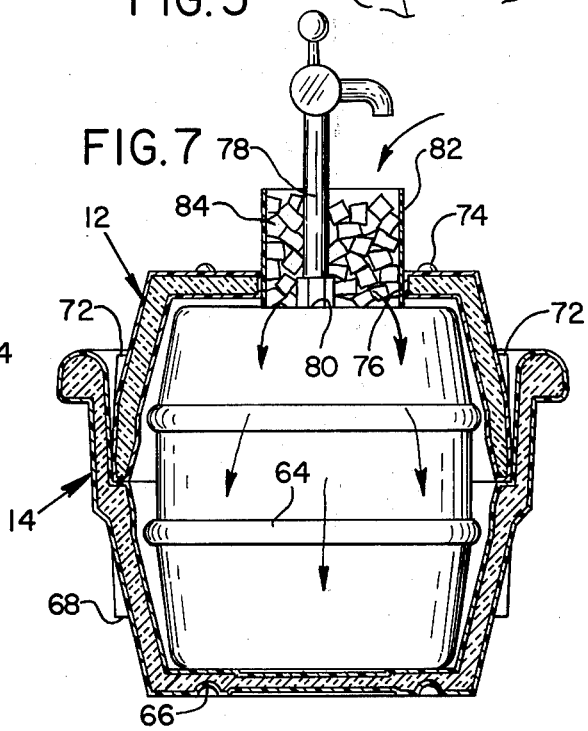

INSULATED BEER KEG CONTAINER

DESCRIPTION

This invention relates to an insulated beer keg container, and has for an object thereof the provision of a new and improved insulated beer keg container.

Because of the public need, there have been certain apparatus and/or devices in prior or present use which by other means have attempted to fill this cold-or-temperature-holding container need, not only in the wholesaling and retailing parts of the beer industry, but more particularly at the point of beverage consumption. The prior art devices have relied principally on use of ice to maintain cold temperatures, but have been found generally unsatisfactory not only because of inefficiency, but because of awkwardness and messiness of handling. In addition, ice, apart from being costly, is often not available at points of beverage consumption, such as picnic grounds, boating, fishing, etc., whereas this invention provides for holding beverage temperatures without ice.

The present invention, by the sealed-in-air principle involved or provided, and by the unique shape of the keg container that conforms to the shape of the keg of beverage that it is designed to contain, does seal off the entrance of warming outside air, and has a center outside hand-gripper ring rim providing unique easy means of dealer and consumer handling. Elaborating on the aforesaid sealing-off, by actual "beer-industry-witnessed" tests, kegs of cold beer held in the keg container of the present invention, for example, for 24 hours in a room temperature of not less than 72° F., the beer when then drawn showed a readily acceptable temperature rise of only 6° F., with no mess or ice fuss such as is necessary in the use of the prior art or devices. Because of the shoulder-to-shoulder match-up (top to bottom sections of the present invention) an adequate airtight seal is accomplished, coupled with the tight sleeve telescope, which provides, in addition to the already 1 inch urethane insulation, another 1 inch, making a total of 2 inches in that vulnerable area. Locking out the outside atmosphere in a various number of methods is one of my invention's key concepts.

Another object of the invention is to provide a beer keg container that will also keep beer cold for longer periods of time with addition of ice through the invention's top orifice.

A further object of the invention is to provide a beer keg container that will handle all types of beer kegs and be usable with all types of taps, including gravity taps. The present invention accommodates all locations of the top-tapping-bung of all makes of beer barrel kegs used throughout the industry and nation — at the same time providing space and room for all the various makes of the tapping instruments to be able to reach and twist (in some cases "required" twisting) into the barrel top-bung mechanical engineering operation, to the ultimate locking position, as well as providing a proper fit for the "orifice extension rack" to snap in properly. (Orifice extension rack accommodates self-feed ice, and acts additionally as the insulating cap to the top hole.)

Another object of the invention is to provide a beer keg container with handles and at the same time accommodate hand trucking as easy as just a keg alone.

Another object of the invention is to provide easiness for consumer handling even while in use and without damage to "consumer attached", expensive tapping equipment.

Another object of the invention is to provide a beer keg container that is very tough and durable.

Another object of the invention is to provide a beer keg container having two sections which can be cross strapped to secure them tightly on a keg regardless of which end or side the container may be rolled or tumbled on.

Another object of the invention is to provide a beer keg container that insulates the keg and its contents well for a matter of days with a minimum of ice, when so desired.

Another object of the invention is to provide not just a beer keg container with excellent heat insulation, but a safe and convenient means for consumer handling of the keg, strong handles being provided so that any number, from one to four, persons can handle the keg and container safely. For example, a full, standard, half-barrel size keg of beer weighs approximately 160 pounds. The keg has no handle; it is cold and usually slippery when the customer picks it up at the brewery, tavern or store, to take home, or on a picnic, fishing or whatever, and really presents a seriously unsafe and inconvenient handling problem when he gets it to the point of use, even with two men handling it. My invention overcomes this handling handicap.

Another object of the invention is to provide a beer keg container adapted without ice, to insulate a cold keg of beer at normal cold temperature sufficiently to allow only a few, six, degrees temperature rise of the keg in a full day's time at an ambient temperature of 72° – 75° F., and in an ambient temperature of 62° F. allow a cold keg of beer, at the normal cold temperatures, to rise 13° F. in a period of sixty-five hours. This is not only for consumer needs but also saves taverns cooler space if keg can be used soon enough (within three days) no ice — allowing taverns to inventory more beer kegs in anticipation of heavy weekend or holiday business and also when the tavern or the person using it in that respect does not have enough refrigerated cooler space to have the extra beer kegs. If iced properly, the temperature can be held low indefinitely. Also, in some instances, it saves distributor costly and messy keg-icing in summer heat delivery (year-round in some areas).

Another object of the invention is to provide filled beer keg containers which, in cool-room warehousing, can be stacked on top of each other with full beer kegs in them, ready for delivery, the kegs having interlocking tops and bottoms.

Another object of the invention is to provide a beer keg container having two sections which can be nested together and in other like containers and cross-strapped for shipping and storage.

Another object of the invention is to provide a beer keg container adapted to permit a carbon dioxide container to be attached to the keg for the purpose of holding the beer's effervescence almost indefinitely.

Another object of the invention is to provide a beer keg container adapted for use with dry ice to rapidly cool beer in the keg when so desired.

Another object of the invention is to provide a beer keg container adapted to keep the beer cold for a matter of days with a couple of trays of ice from a home refrigerator.

Another object of the invention is to provide a beer keg container with a hollow, truncated rubber ball seal for a gravity flow tap.

Another object of my invention is to provide a means for substantial consumer savings. It is well established that the American public wants its beer, milk and solf drink beverages cold at the time of consumption. My invention provides a method for maintaining the temperature that the liquid had when it left the supplier's cooler. From an economic standpoint, the public also wants its favorite cold beverage at the lowest cost per ounce, consistent with safety and convenience of handling from point of pickup to and including point of use. Key purchase price of beer contents in draft form is many times cheaper than when purchased in bottle form.

In the drawings:

FIG. 4 is an exploded perspective view of the container of FIG. 1;

FIG. 5 is a fragmentary, vertical sectional view of the container of FIG. 1;

FIG. 6 is a vertical sectional view of a plurality of containers like that of FIG. 1 in a stack for shipping and, FIG. 7 is a vertical sectional view of the container of FIG. 1.

Figure 1:
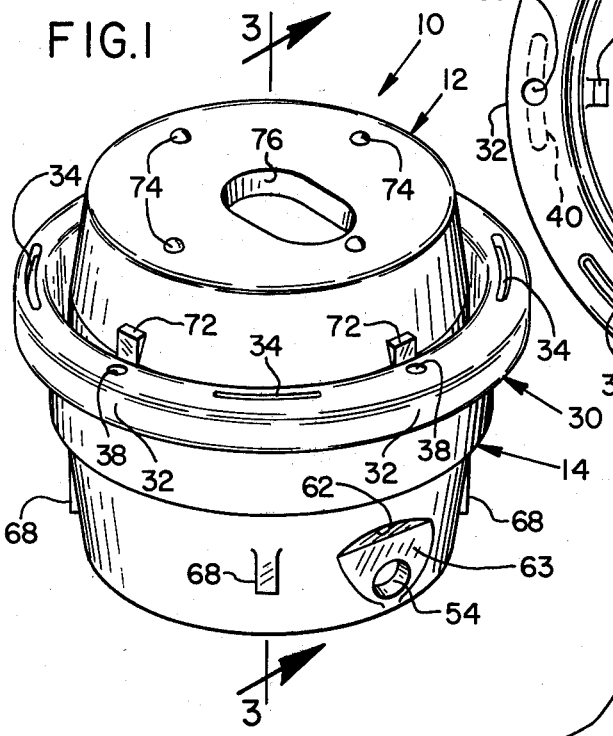
FIG. 1 is a perspective view of a beer keg container forming one embodiment of the invention.

A beer keg container 10 (FIG. 1) forming one specific embodiment of the invention includes a cup-shaped top section or tub 12 and a cup-shaped bottom section or tub 14, and is adapted to keep a cold beer containing keg 16 (FIG. 3) cold for over one day without ice and indefinitely with small amounts of ice and to cool a warm keg of beer with dry ice. The sections have very tough, heat insulating, integral double wall or hollow outer shells 18 and 20 (FIG. 3) of high density polyethylene without seams and rotationally molded. The spaces or cavities between the walls of the shells are filled with a low density plastic foam 22 (FIG. 3) of good heat insulation, such as, for example, foamed polyurethane.

The bottom section 14 (FIGS. 1, 2 and 3) has a ring or rim 30 having four downwardly rolled strong handle portions 32 with portions therebetween having tape guiding slots 34 for binding tapes or straps 36 (FIG. 5). Holes 38 (FIGS. 1, 2 and 4) for optionally using binding ropes (not shown) instead of the tapes also are provided. Recesses 40 (FIGS. 2, 3 and 4) are provided for receiving the fingers of a person or persons handling the container.

Figure 2:
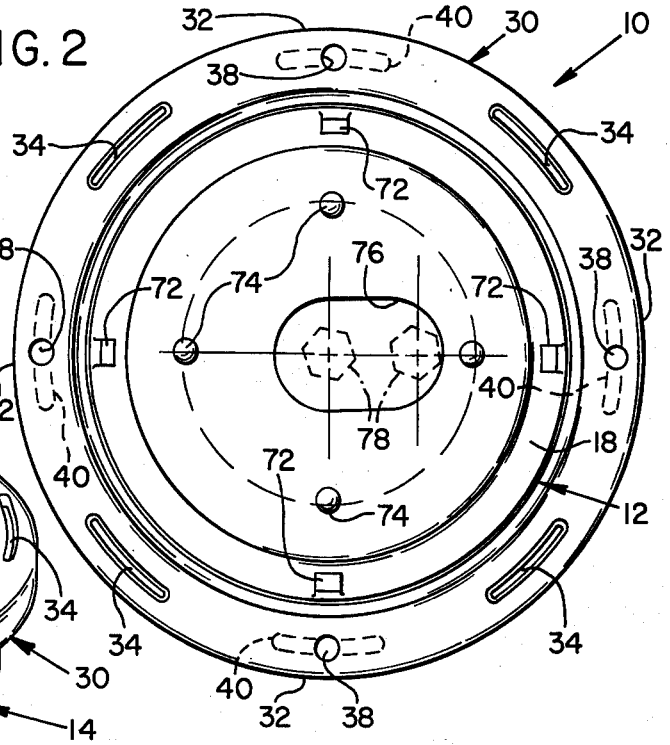
FIG. 2 is a top plan view of the container of FIG. 1.
Figure 3:
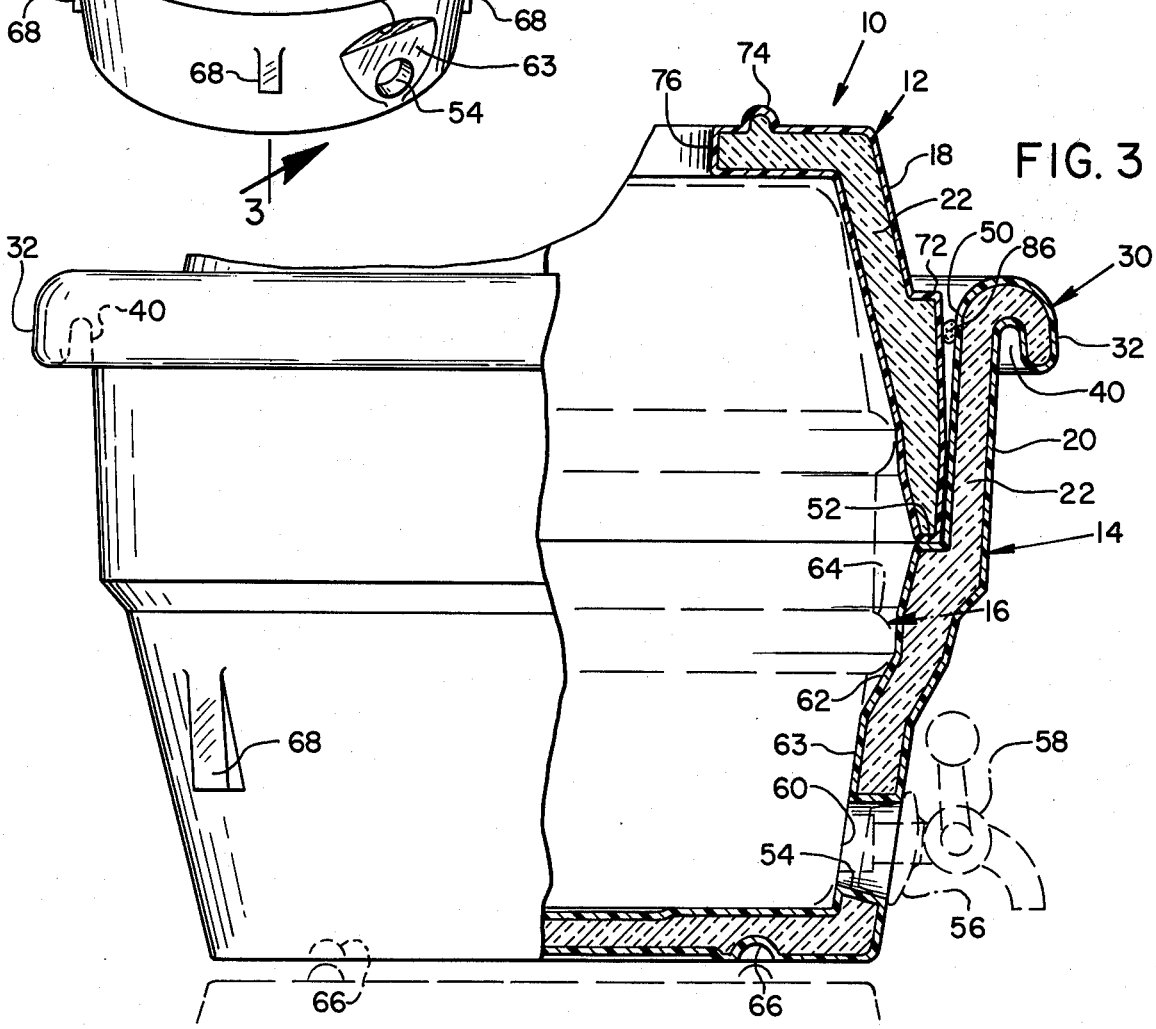
FIG. 3 is a partially sectional view taken along line 3—3 of FIG. 1.

The section 14 (FIG. 4) has a long telescopic, slightly tapered interiorly, socket portion 50 (FIG. 3) with a stop shoulder 52 (FIGS. 3, 5 and 6) and has a bung access hole 54 (FIGS. 1, 3 and 4) for receiving a truncated hollow ball 56 (FIG. 3) through which a spigot 58 (FIG. 3) may extend to and tapped into a lower bung 60 (FIG. 3) of the keg. The section 14 is indented at 62 to leave a flat, recessed wall 63 containing the hole 54 (FIGS. 1, 3 and 4). The sloping portion 62 is just below an annular rib 64 (FIGS. 3 and 7) of the keg to provide clearance for the rib. The section 14 also has semispherical keying sockets 66 (FIGS. 3, 4, 5 and 6) and stop lugs 68 (FIGS. 1, 3, 4, 6 and 7).

The top section 12 (FIGS. 2 and 3) has an elongated slightly tapered exteriorly telescoping portion 70 slidable in the portion 50 and has stop lugs 72 adapted to rest on the stop shoulder 52 (FIG. 6). The top section also has keying hemispherical projections or buttons 74, and an elliptical ice hole 76 for an upper top 78 to a top bung 80 of the keg, the ice sealing the hole and resting in the cupped top of the keg. A sleeve 82 fits in the hole 76 to retain ice 84 to seal the hole 76. The seal preferably is a flexible plastic cylinder deformable to fit into the generally elliptically shaped hole 76 and is retained in the hole 76 by friction. If no ice is used, a cloth or paper or the like may be used to substantially seal the hole 76. A gasket 86, which may be a rope or an elastic O-ring or the like, may be placed in the tapering overlapping portions of the sections to seal off the small space between the sections.

As best shown in FIGS. 3 & 5, the long overlapping telescopic portions of the container adapt it to handle beer kegs of different lengths, both a longer beer keg as shown in FIG. 5 and a shorter keg as shown in FIG. 3. The sections may be securely held together in either case during use and/or storage by cross straps 36 retained by the slots 34. Also, the top section 12 is adapted to fully nest in the bottom section 14 as best shown in FIG. 6. The bottom section also can nest in the bottom section of another identical container, for shipping as shown in FIG. 6. The containers can be stacked one on top of the other as shown in FIG. 5 with the keying button 74 fitting in the V sockets 66.

With the water to diffuse the coldness derived from the dry ice, it is distributed evenly in the beer keg container of the present invention.

It is industry policy that the consumer has to make a deposit on the tapping equipment to protect the beer distributor against breakage of his expensive tapping equipment (consumer forfeiting deposit if he breaks the tapping equipment). It often happens that the consumer, because of the delicate construction of a top bung tapper, equipment, and the consumer's natural instinct to use the top tap for a convenient handle, he will use it to help move the keg and in so doing he bends the tapping equipment and forfeits his deposit. And in many cases on weekends the customer is unable to get a replacement, and thereby also loses the opportunity to even utilize the full keg of beer at all. Such an experience is disheartening to all concerned, and a waste of dollars if the beer cannot be kept cold enough to return Monday (or whatever day) to the distributor.

Dry ice also has its place with the beer keg container of the present invention and is desirably used. The advantage of using dry ice provides the consumer with the advantage of saving waste especially of bulk liquids in large containers that are not convenient in size for the consumer to store in his home refrigerator. Eight pounds of dry ice will pull the temperature of ten gallons of liquid down approximately 20° within 20 minutes, thus accommodating the consumer for use of the liquid at a subsequent time period (days, weeks, months, etc. later) at a desirable drinking temperature.

Instructions for using dry ice with the beer keg container of this invention are very simple. The bottom section of the keg container with the beverage container already inserted is to be half filled with plain water. Not very much water is necessary to fill the keg container half full because of the displacement area taken up by the liquid beverage container. Drop the dry ice into the water in several broken pieces, replace the top section of the keg container and let sit until the dry ice is dissolved, i.e. ten gallons approximately twenty minutes; eight pounds for a 20° drop in temperature. If more than a 20° drop in temperature is desired of the beverage, then increase the dry ice quantity by some equivalent measure. Use of water when inserting the dry ice in the keg container is essential, because the water diffuses the concentrated coldness of the dry ice. Without water to diffuse the dry ice, it would only spot cool the liquid in its container.

What is claimed is:

1. A container for a keg of beer or other liquid, comprising:

a pair of insulating tubs facing one another in interfitted telescopic relationship about the keg, and separable to facilitate replacement or removal of said keg, one of the tubs being a deep lower tub of circular horizontal cross section and having a base and an upright sidewall terminating in an annular rim, said rim providing a hand hold for lifting the container, said sidewall being of a height exceeding one-half the height of the keg to be contained, so as to dispose said rim at a place above the center of gravity of the keg to avoid tipping tendencies when carrying the keg, the other of said tubs being an inverted upper tub of smaller size than that of the lower tub and having a top wall and a depending sidewall of circular cross section telescoped downwardly within the upper portion of the lower tub in separable contact therewith, at least one of said tubs having an opening formed therethrough to facilitate tapping the keg while it is insulated by said container.

2. A container as described in claim 1, in which the sidewalls of said tubs define, at the place said tubs telescope, a downwardly tapering annular crevice to receive insulation.

3. A container as set forth in claim 2 in which there is circular insulation disposed in said crevice in spaced relation from the lower end thereof to define a dead air insulating space.

4. A container as set forth in claim 3, in which the upper portion of the sidewall of the lower tub is offset outwardly from the lower portion of the sidewall of the lower tub to provide an internal annular shoulder, the sidewall of the upper tub terminating in an annular edge of substantially the same size as and seating on said shoulder.

5. A container as set forth in claim 1 in which the upper portion of the sidewall of the lower tub is offset outwardly from the lower portion of the sidewall of the lower tub to provide an internal annular shoulder, the sidewall of the upper tub terminating in an annular edge of substantially the same size as and seating on said shoulder.

6. A container as set forth in claim 5, wherein the upper portion of said upper tub is of a lesser size than that of the upper part of the lower portion of the lower tub so that said upper tub can be reversed in position and nested down within the lower tub for shipping or storage purposes, the lower portion of the upper tub being of a size to nestingly receive the lower portion of said lower tub to facilitate nesting of a lower tub within an upper tub for shipping or storage purposes.

7. A container as set forth in claim 6, in which said upper tub has exterior stacking lugs engaging said shoulder of a lower tub in the reversed position of said upper tub, and said lower tub having exterior lugs for engaging the rim of the upper tub in the stacked condition of plural containers.

8. A container as set forth in claim 1, wherein said rim comprises a downturned annular margin spaced from the main portion of said sidewall to provide a hand hold extending completely around the container.

9. A container as set forth in claim 8, wherein the upper portion of said upper tub is of a lesser size than that of the upper part of the lower portion of the lower tub so that said upper tub can be reversed in position and nested down within the lower tub for shipping or storage purposes, the lower portion of the upper tub being of a size to nestingly receive the lower portion of said lower tub to facilitate nesting of a lower tub within an upper tub for shipping or storage purposes, said margin having holes formed therein to receive elongate binding elements to facilitate securement together of the tubs of a container.

10. A container as set forth in claim 1 in which each of said tubs comprises a tough, high density polyethylene skin defining a hollow space which is filled with a low density plastic foam.

11. A claim as set forth in claim 1, wherein each tub has an opening formed therein, the opening for the upper tub being in its top wall and being radially elongate to register with top bung holes of different types of kegs, the opening for the lower tub being in its sidewall, a sealing plug adapted to fit into the just mentioned opening and having a passage therethrough for a bottom tap.

12. A container for a keg of beer or other liquid, comprising:

a pair of insulating tubs facing one another in interfitted telescopic relationship about the keg, and separable to facilitate replacement or removal of said keg, one of the tubs being a lower tub of circular cross section and having a base and an upright sidewall terminating in an annular rim, hand holds provided on said lower tub to facilitate lifting said container, the sidewall of said lower tub having a lower portion of internal size that approximates the external size of the lower portion of the keg, and having an upper portion of substantially larger internal size than the external size of the associated portion of the keg to provide a gap between the keg and said upper portion, the other of said tubs being an inverted upper tub of smaller size than the lower tub and having a depending wall of circular cross section of a size to telescope downwardly within the upper portion of the lower tub and to occupy the gap in separable frictional contact with the upper portion of the lower tub, at least one of said tubs having an opening therethrough to facilitate tapping the keg.

13. A container as recited in claim 12, wherein the frictional contact between the upper tub and lower tub is provided by internal shoulder formed on the interior of the lower tub, located to be engaged by the lower edge of the depending wall of the upper tub.

* * * * *